US007144356B2

(12) United States Patent
Harnish

(10) Patent No.: US 7,144,356 B2
(45) Date of Patent: Dec. 5, 2006

(54) ADJUSTABLE, SELF-CORRECTING WEB SUBSTRATE FOLDING SYSTEM

(75) Inventor: David Alan Harnish, Maysville, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 685 days.

(21) Appl. No.: 10/143,209

(22) Filed: May 10, 2002

(65) Prior Publication Data

US 2003/0211923 A1 Nov. 13, 2003

(51) Int. Cl.
*B31B 1/00* (2006.01)

(52) U.S. Cl. ..... 493/8; 493/17; 493/18; 493/29

(58) Field of Classification Search ..... 493/460, 493/461, 459, 455, 442, 8, 17, 18, 23, 29, 493/414

See application file for complete search history.

(56) References Cited

U.S. PATENT DOCUMENTS 3,111,310 A 11/1963 Dutro et al.
3,845,948 A 11/1974 Furbeck et al.
3,949,655 A * 4/1976 Gold ..... 493/32
4,061,325 A 12/1977 Marcalus et al.
4,131,271 A 12/1978 Slawny
4,203,584 A 5/1980 Smaw
4,300,891 A * 11/1981 Bemiss ..... 493/8
4,321,051 A 3/1982 Hajek et al.
4,502,675 A 3/1985 Clark et al.
4,699,606 A * 10/1987 Whitley et al. ..... 493/4
4,782,987 A * 11/1988 Giacomelli et al. ..... 226/2

(Continued)

FOREIGN PATENT DOCUMENTS

GB 862296 3/1961

(Continued)

OTHER PUBLICATIONS

Roisum, D. R. et al., "Web Bagginess: Making, Measurement and Mitigation Thereof," Finishing Technologies, Inc., USA.

*Primary Examiner*—John Sipos
*Assistant Examiner*—Christopher Harmon
(74) *Attorney, Agent, or Firm*—David R. Mattheis; Peter D. Meyer; Leonard W. Lewis

(57) ABSTRACT

An adjustable, web-folding system for folding a web substrate. The adjustable web folding system has an adjustable folding detour and at least one sensor for measuring a characteristic of a web substrate. A surface of the adjustable folding detour, or the folding detour, is adjustable in response to the value of the characteristic of the web substrate.

20 Claims, 3 Drawing Sheets

U.S. PATENT DOCUMENTS

| | | | | |
|---|---|---|---|---|
| 4,787,325 | A | | 11/1988 | Black et al. |
| 4,952,281 | A | * | 8/1990 | Akira ..... 162/270 |
| 5,018,461 | A | | 5/1991 | Kato et al. |
| 5,052,296 | A | | 10/1991 | Shiba |
| 5,092,573 | A | | 3/1992 | Abreu |
| 5,148,760 | A | | 9/1992 | Miyauchi |
| 5,176,371 | A | | 1/1993 | Rau et al. |
| 5,203,136 | A | | 4/1993 | Thimon et al. |
| 5,247,781 | A | | 9/1993 | Runge |
| 5,443,024 | A | | 8/1995 | Wethington et al. |
| 5,553,564 | A | | 9/1996 | Putney |
| 5,716,311 | A | | 2/1998 | Novick et al. |
| 5,775,222 | A | | 7/1998 | Zweifel et al. |
| 5,779,616 | A | | 7/1998 | Hintermeier et al. |
| 5,902,222 | A | * | 5/1999 | Wessman ..... 493/439 |
| 5,927,197 | A | | 7/1999 | Surya |
| 6,036,805 | A | | 3/2000 | McNichols |
| 6,071,223 | A | * | 6/2000 | Reider et al. ..... 493/410 |

FOREIGN PATENT DOCUMENTS

| | | |
|---|---|---|
| GB | 946816 | 1/1964 |
| GB | 1413124 | 11/1975 |

* cited by examiner

ADJUSTABLE, SELF-CORRECTING WEB SUBSTRATE FOLDING SYSTEM

FIELD OF THE INVENTION

The present invention relates to an adjustable, self-correcting web substrate folding system that can sense a physical characteristic of a moving web substrate that is undergoing folding and adjust the fold angle geometry to provide the correct tension.

BACKGROUND OF THE INVENTION

As is known in the art, folding a web substrate generally involves the manipulation of the web substrate according to principles of equal path length. Simply stated, the machine direction (MD) folding of a web substrate for equal path lengths requires each cross-machine direction (CD) point of the web substrate to travel an equal geometric distance (equal path geometry) across a folding surface. Thus, each portion of the web substrate is provided with equal tension and proper web tracking. As is known in the art, equal path geometry provides the best processing for a uniform web.

Tearing or the reduction of baggy edges during a folding operation generally requires stopping the folding line to enable personnel to effect manual changes to the equal path geometry. Stoppages result in lost production time and increased production costs. Additionally, manual changes are generally inaccurate and may require additional production stoppage in order to affect further serial, or incremental, equal, or unequal, path geometric changes. Further, a line stoppage requires an entire web substrate processing line be shut down at the parent roll stage. Such a shut down can result in capital losses, due to the inability to produce any intermediate or end products during the period of time the processing line is down.

Equipment for completing folds in high-speed web processes is well known in the art. Folding formers, folding plates, and "V"-folders, and the like, are machined detours and polished sheet metal elements over which a web substrate is guided. A typical "V"-folder would consist of a generally triangular structure that would include a folding plate surface that initially receives the moving web substrate. A folding plate is a generally flat surface with a pair of spaced-apart converging edges. A folding plate typically has a terminal nose surface contiguous to the transition nose surface and merges smoothly therewith forming an oblique angle with it. The terminal nose portion terminates in a point that defines the location of the fold.

Typically, and as is generally known to one of skill in the art, a folding detour generally has a first, or input, angle, $\alpha$, a second, or side, angle, $\beta$, and a third, or resultant, angle, $\gamma$, and will generally fold a web substrate along the longitudinal axis of the web substrate. During folding, failure to maintain a proper relationship between the input angle, $\alpha$, side angle, $\beta$, and/or resultant angle, $\gamma$, can cause folding equipment stoppages. This is because one edge of the web substrate is longer than the other, and the fold geometry must be adjusted accordingly.

The tendency for a web substrate passing over folding structures to not run or lay flat and straight is generally due to a folding phenomenon hereinafter referred to as a "baggy edge." A baggy edge can result when one edge of a roll of web stock is physically longer than the other edge. This physically longer, or curved, edge can be demonstrated by rolling out an amount of web material and observing a general "C"-shape, or curve, in the rolled-out portion.

A baggy edge could exist because of either a deviation of strain, stress, or flatness in the web substrate. Additionally, cambered web substrates, common on narrow webs that have been cut from a wide parent roll of web substrate, can also have sufficient deviation to produce a baggy edge in a web substrate folding operation.

A baggy edge, or baggy web substrate, can cause wrinkling during a folding operation due to an insufficient machine direction (MD) tension. This baggy edge may result in a bubble, leaving wrinkles in the folded substrate and causing potentially significant deviations in the ability to laminate or coat, or the lack of ability to produce flat material bonding, or provides difficulties in passing a moving web substrate over flat rollers. This off-quality product requires operator intervention to correct and typically requires the complete shut down of a folding operation and an ensuing loss of production efficiency.

A typical folder is shown in Dutro, U.S. Pat. No. 3,111,310. Dutro discloses a complex series of folding plates for making a fold in a web or ribbon of paper. Curved flanges bound the converging edges of the fold plate and transition nose surfaces. A flue is formed integrally within the flanges. Dutro uses conventional folding plate technology and does not allow for in situ adjustment of the folding plate to reduce a baggy edge in a passing web substrate.

Similarly, other patents show the use of folding plates in various configurations. Exemplary patents include: Great Britain Patent Nos. GB 946,816, GB 1,413,124, and GB 862,296, and U.S. Pat. Nos. 4,131,271; 4,321,051; and 5,779,616. However, none teach or disclose a device that provides continuously adjustable, self-correcting tension on a passing web substrate undergoing folding.

However, because nips are widely used in the industry for laminating, printing, winding, coating and calendaring, it is essential to minimize bagginess, or over-tension, in a moving web substrate. Roisum, Web Bagginess: Making, Measurement and Mitigation Thereof, suggests that line tension can be increased in the machine-direction to remove contraction from the shorter edge of a web to reduce bagginess. Thus, only a machine direction tension is applied to the shorter edge of a web substrate in an attempt to lengthen the shorter edge. However, Roisum also suggests that this method has several limitations and can be difficult to achieve. Most significantly, it is suggested that this technique does not work well with stiff webs that may break before flattening. Additionally, it is suggested that this process may not provide uniform results as small puckers may still occur in the web substrate, resulting in an imperfect edge. Further, the application of additional machine direction tension becomes difficult in application when several web substrates are combined in-line. If one web substrate exhibits properties of non-uniformity, in-line tension must be applied to all webs being combined. To apply tension to only one web of a plurality of combined webs can cause ruffling in the final product, a potentially undesirable end result.

Accordingly, it would be desirable to provide an adjustable, self-correcting web substrate folding system for in situ folding of a web substrate that can provide continuous adjustments to the web substrate folding system prior to web substrate contact with a folding detour. This can minimize web substrate bagginess during folding and yet still provide a high quality finished product.

SUMMARY OF THE INVENTION

The present invention is an adjustable web folding system for folding a web substrate having a machine direction and a cross-machine direction. The adjustable web folding system comprises an adjustable folding detour disposed in a position and having a longitudinal axis coincident with the machine direction of the web substrate; at least one sensor for measuring a characteristic of the web substrate prior to said the substrate contacting the adjustable folding detour; and, wherein the position of the adjustable folding detour is adjustable in response to the value of the characteristic of the web substrate prior to the web substrate contacting the adjustable folding detour.

The present invention is also an equal path folder comprising a folding detour having a longitudinal axis for producing a fold in a web substrate having a longitudinal axis, a machine direction, and a cross-machine direction, with the web substrate moving in the machine direction. The folding detour has a folding angle disposed thereon; a first force measuring sensor for measuring a first force in the web substrate prior to the web contacting the folding board; a second force measuring sensor for measuring a second force in the web substrate prior to the web contacting the folding board. The first force and the second force are compared and produce a resultant force; and, the folding angle is adjustable in relation to the value of the resultant force prior to the web contacting the folding board.

All patent and non-patent references cited are herein incorporated by reference.

DETAILED DESCRIPTION OF THE INVENTION

The present invention is an adjustable, self-correcting web substrate folding system. The adjustable, self-correcting web substrate folding system is generally capable of measuring a differential, or comparative web characteristic, such as a resultant tension force, and adjusting the fold angle of the web folding system in response to the value of the measured differential web characteristic. As used herein, "machine direction" refers to the general direction of travel of a web substrate along the longitudinal axis of the web substrate. As used herein, "cross-machine direction" generally refers to the axis that is orthogonal to the MD and coplanar with the web substrate. The "z-direction" generally refers to the axis that is orthogonal to both the machine- and cross machine directions. Further, it is generally known that the first, or input, angle, $\alpha$, generally refers to a fold in the z-direction of a web substrate. It is also generally known that the third, or resultant, angle, $\gamma$, generally refers to a fold in the cross-machine direction of a web substrate. It is further generally known that the second, or side, angle, $\beta$, generally refers to a compound fold between the input angle, $\alpha$, and the resultant angle, $\gamma$, and generally comprises a fold in both the z- and cross-machine directions. The transition point is generally known as the point of intersection for angles $\alpha$, $\beta$, and $\gamma$.

Figure 1:
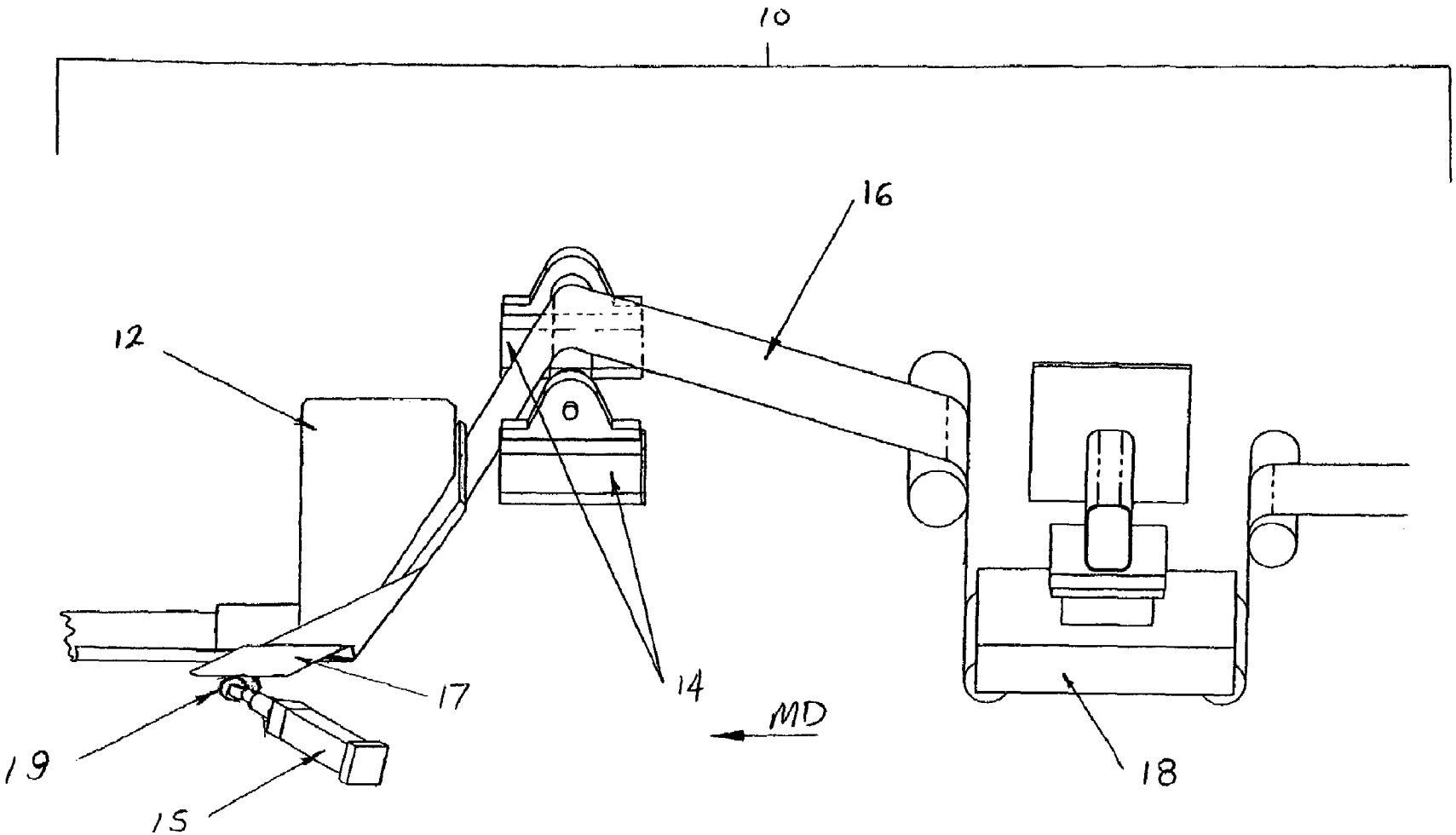
FIG. 1 is a perspective view of a preferred embodiment of an adjustable, self-correcting, web substrate folding system, with an exemplary web substrate being folded, in accordance with the present invention.

As shown in FIG. 1, the adjustable, self-correcting, web folding system is represented by the numeral 10. The adjustable, self-correcting, web folding system 10 generally comprises an adjustable folding detour 12 and at least one sensor (sensor) 14 for measuring a characteristic of a web substrate 16 traveling in the machine direction (MD). The adjustable, self-correcting, web folding system 10 can also comprise optional guide 18, and an optional at least one sensor 19 positioned downstream, in the MD, from folding detour 12 or in the resultant angle, $\gamma$, of folding detour 12. Within the scope of the present invention, sensor 14 can comprise any number of sensors. However, it is preferred that sensor 14 be capable of producing a measurement that is representative of some characteristic of the web substrate 16 that may ultimately bear a relationship to the folding of web substrate 16. That is, the characteristic of the web substrate 16 chosen should be indicative of a characteristic of web substrate 16 that can vary from one substrate to another, or within the same substrate, in either the machine- or cross-machine direction, or any combination thereof.

As would be known to one of skill in the art, non-limiting and exemplary, folding detours 12 can comprise a single, or a cascaded series of folding boards, folding plows, folding rails, goat horns, ram horns, turn bars, folding formers, folding fingers, and combinations thereof. As would also be known to one of skill in the art, any combination of folding devices can be combined to form any number of folds as required by a folding operation. For example, two folding rails, each having a folding edge disposed thereon, can be combined to make a "V"-folder. Likewise, as would be known to one of skill in the art, a series of "V"-folders can be combined to produce a "C"-folder. Similarly, as would be known to one of skill in the art, several folding plows positioned in series in the machine direction can complete a series of two tucks in web substrate 16 to produce a "Z"-folder. In any regard, as web substrate 16 progresses through each portion of folding detour 12, it is desirable that web substrate 16 maintain equal path folding geometry. Illustrative depictions of exemplary, but non-limiting, adjustable, self-correcting, web folding systems are described in Examples 11–13 infra.

Exemplary, but non-limiting, web characteristics that can be measured include tension, opacity, caliper, shear, basis weight, denier, elongation, air flow, stress, strain, modulus of elasticity, coefficient of friction, surface finish RMS, yield strength, color, stiffness, bending modulus, temperature, dielectric constant, static electric charge, physical composition, and combinations thereof. Exemplary, but non-limiting, sensors 14 for measuring web characteristics include a beam and fulcrum, strain gauges, optical sensors, photoelectric sensors, electrical sensors, electro-mechanical sensors, opacity sensors, ultrasonic sensors, inductive sensors, variable reluctance sensors, magneto-strictive sensors, laser sensors, nuclear sensors, and combinations thereof. In a preferred embodiment, sensor 14 includes a pair of load cells sensitive to the tension present in cross machine direction edges of moving web substrate 16. Illustrative depictions of exemplary, but non-limiting, sensor 14 arrangements and techniques are detailed in Examples 1–10 infra.

Figure 2:
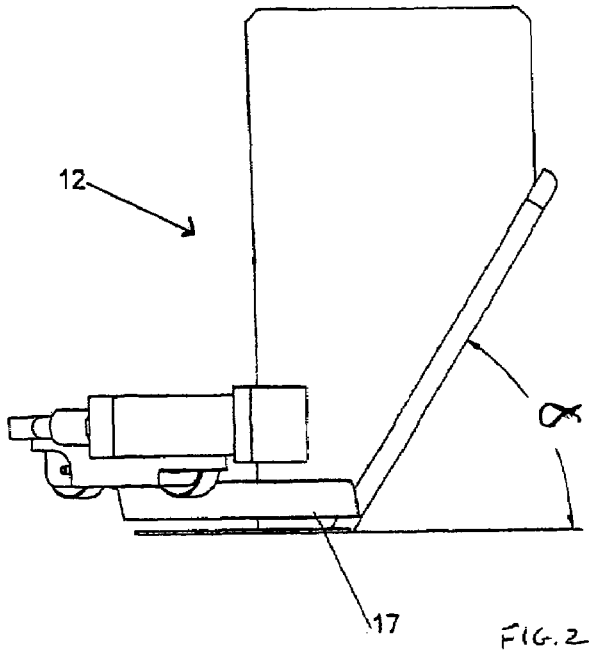
FIG. 2 is an elevational view of an adjustable, self-correcting, web substrate, folding detour.
Figure 3:
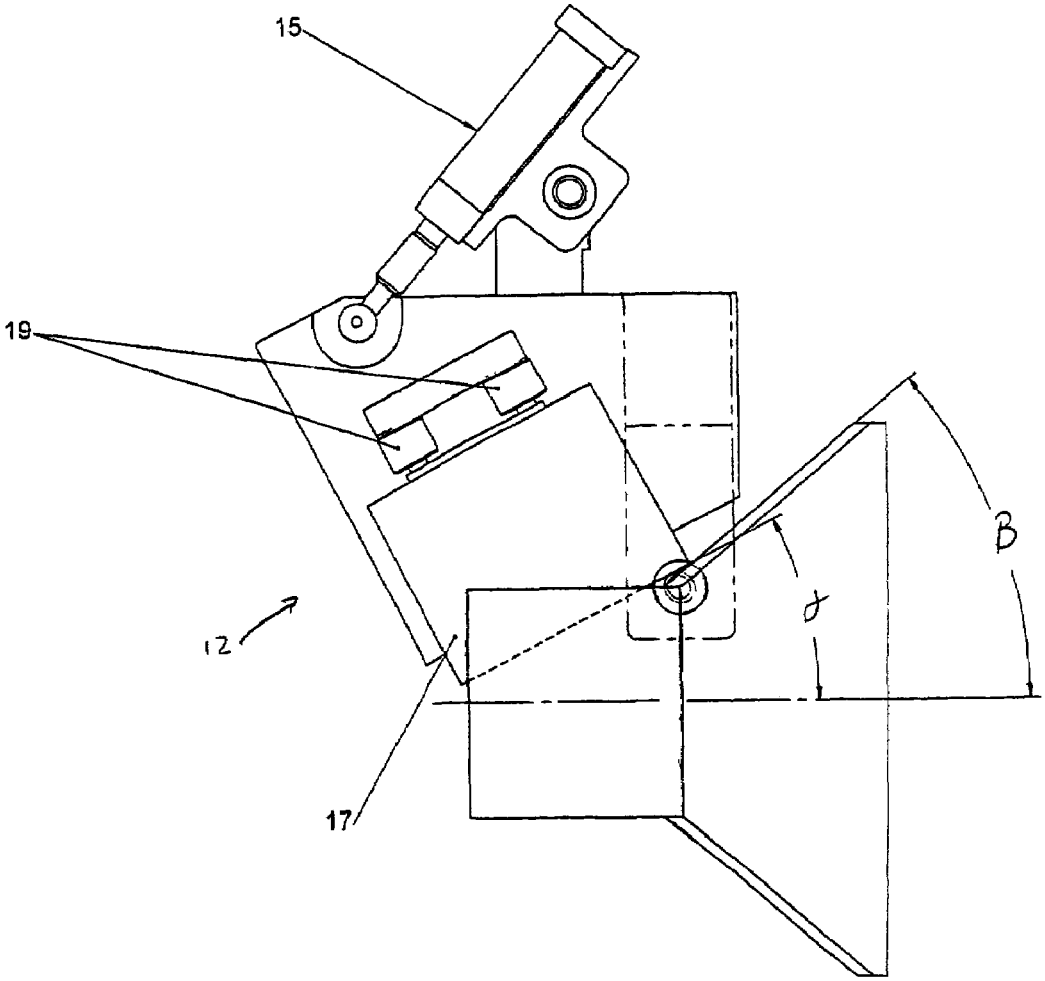
FIG. 3 is a bottom view of an adjustable, self-correcting, web substrate, folding detour.
Figure 4A:
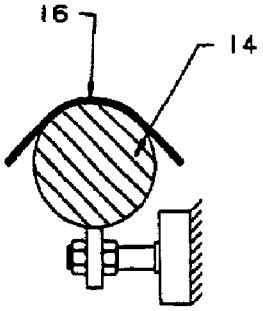
FIG. 4 is a view of an exemplary single-sensor for use with an adjustable, self-correcting, web substrate folding system; and, FIG. 4A is a cross sectional view of the exemplary single sensor of FIG. 4 taken along the line 4*a*–4*a*.
Figure 4:
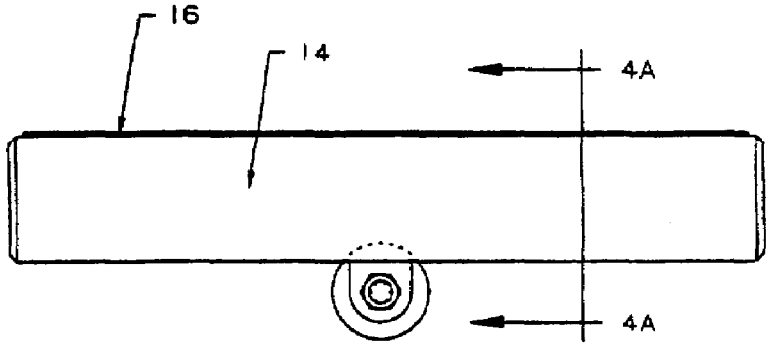

As shown in FIGS. 2 and 3, folding detour 12 can be moveable, adjustable, and/or provided with at least one surface that is moveable and/or adjustable, or provided with an edge, or break, 17 with which it is possible to change at least one angle (α, β, or γ) of the overall equal path geometric fold provided by folding detour 12. Thus, the edge can be disposed at and angle relative to the longitudinal axis, thus defining an angle therebetween. In other words, moveable break 17 could be associated with a change in any one of angles α, β, or γ, or can be arranged to adjust any combination of angles α, β, or γ, and thus, the included angle. In a preferred embodiment, folding detour 12, or moveable break 17, can be adjusted in response to the value of at least one differential web characteristic present between cross machine direction edges of web substrate 16 as measured by sensor 14. The value of at least one differential web characteristic can be the magnitude of the differential web characteristic. For example, if the resultant of the sensor 14 measurement determines that one edge of web substrate 16 has a higher tension (i.e., has a shorter overall length) than the other edge (i.e., a differential, or resultant, tension is present), then input angle α, side angle β, and/or resultant angle γ of folding detour 12 could adjust away from the higher tension side of web substrate 16 (i.e., angle α becomes smaller) until the value of the measured differential web characteristic approaches zero. Ideally, a web substrate 16 experiencing no differential web characteristic as measured by sensor 14, and adjusted by folding detour 12, produces a fold exhibiting no bagginess. It is believed that actuator 15 could be coupled to moveable break 17, or folding detour 12, to provide movement of moveable break 17, and/or folding detour 12, upon detection of a differential web characteristic by sensor 14.

As shown in FIGS. 3 and 3A, an exemplary, and non-limiting, sensor 14 capable of measuring a differential web characteristic of web substrate 16, for example a differential tension, could be a mechanical beam pivotable about a fulcrum. As the web substrate 16 passes over the beam, the beam could balance about the fulcrum in relation to the differential tension present in the cross machine direction of web substrate 16. As the cross machine direction web tension of moving web substrate 16 increases, or decreases, on one edge due to inconsistent web substrate 16 edge lengths, the beam could pivot about the fulcrum, thus providing a measurement of the differential tension between both edges of the web substrate 16. The differential tension measured could then result in an adjustment of moveable break 17 or folding detour 12 in any one of the angles (α, β, and/or γ) present in folding detour 12 in response to the magnitude of the upstream measurement.

As shown in FIG. 2, an exemplary, and non-limiting, sensor 14, capable of measuring a differential web characteristic, would provide two sensors capable of measurement of a differential web characteristic of web substrate 16. It is preferred that both sensors 14 be equally spaced from the longitudinal axis of web substrate 16, however, one of skill in the art would be able to place two sensors 14 at any two points bounding web substrate 16 in the machine direction, cross machine direction, or any combination thereof, and still be able to provide a measurement of a differential web characteristic of web substrate 16. For example, the differential tension of web substrate 16 present between the sensors 14 could result in an adjustment in any one of the angles (α, β, and/or γ) present in folding detour 12 in relation to the magnitude of the upstream measurement.

An exemplary, and non-limiting, sensor 14 system comprising multiple sensors 14 capable of measuring a differential web characteristic would provide a plurality of sensors 14 capable of measurement of the web substrate 16 differential web characteristic in the general cross machine direction of web substrate 16. As would be known to one of skill in the art, generally arranging a plurality of sensors 14 in the cross machine direction of a web substrate 16 could supply the additional benefit of providing a more accurate depiction of any web deformities, or inconsistencies, in terms of a deformity profile of a web substrate 16. Additionally, the deformity profile could provide the ability to track single or multiple web substrate characteristics over time in order to develop angle adjustment profiles for various web substrates. Based upon the profile provided by a plurality of sensors 14, it could be possible to provide for an even more consistent fold and further reduce web substrate 16 bagginess. Additionally, a plurality of sensors 14 could be advantageous in the ability to accommodate virtually an infinite arrangement of folds in terms of the number of folds undergone by web substrate 16 and amount of fold-over undergone by web substrate 16 as web substrate 16 progresses though a series of folding detours 12.

Referring again to FIG. 1, in any regard, it is preferred that sensor 14 be capable of producing at least one quantifiable measurement of a characteristic of web substrate 16. Thus, it would be known to one of skill in the art that the quantifiable measurement made by one sensor 14 could be compared with the quantifiable measurement made by another sensor 14. The value of the comparison of quantifiable measurements made by at least one sensor can be used so that folding detour 12 can be adjusted, as described supra, to maintain uniform tension in the web substrate 16 prior to contact with folding detour 12. In essence, this would be known to one of skill in the art as a feedback loop, or a form of error correction. Maintenance of constant web tension throughout web substrate 16 can reduce the bagginess in web substrate 16 after contact with folding detour 12. Additionally, one of skill in the art would realize that it is possible to place at least one sensor 19 downstream in the machine direction from folding detour 12 to provide additional measurements of web substrate 16. Additionally, sensor 19 can be placed in the resultant angle, γ, of folding detour 12, however, one of skill in the art could place sensor 19 in any of the included angles α, β, and/or γ, or downstream, in the machine direction, from the resultant angle, γ, of folding detour 12. Such additional measurements of web substrate 16 can provide further feedback of web characteristics to enable folding detour 12 to be incrementally adjusted to further reduce web substrate 16 bagginess.

Again referring to FIG. 1, continuously adjustable web folding system 10 can be provided with guide 18. The central portion of guide 18 could be placed prior to sensor 14 to provide for tracking of the longitudinal axis of web substrate 16 in the machine direction. That is, the longitudinal axis of web substrate 16 would preferably align with the MD axis of sensor 14 and/or folding detour 12. Overlapping the longitudinal axis of web substrate 16 with the MD axis of sensor 14 and folding detour 12 could also facilitate the removal of any bagginess in the web by ensuring that any folds experienced by web substrate 16 are produced around the MD axis of folding detour 12.

It is also believed that one skilled in the art could fold a web substrate using an adjustable, self-correcting web substrate folding system by supplying a web substrate and an adjustable folding detour. The skilled artisan could then measure a characteristic of the web substrate prior to the web substrate contacting the adjustable folding detour. The adjustable folding detour could then be adjusted, as described supra, in response to the value of the measured characteristic of the web substrate.

EXAMPLES

The following examples describe non-limiting, exemplary web substrate 16 baggy, or tight, edge detection methods consistent with the scope and spirit of the present invention. All detection methods could provide a control signal that activates the adjustable, self-correcting, web substrate folding system (system) by increasing the tension on the loose edge, or decreasing the tension of a taut edge of a moving web substrate 16.

Example 1

Strain Gauge (Load cells):

An electrical voltage is passed through a calibrated wire or semi conductor matrix bonded to a flexural member. A force applied to the flexural member causes flexion in the matrix thereby varying the resistance of the matrix. The change of voltage is calibrated to known forces for a given flexion range.

Employing two strain gauges on opposing ends of a connecting bar or idler can facilitate monitoring of both edges of a web substrate. As a substrate passes over a connecting idler, the two edges of the web can be monitored to indicate if one edge is exerting less force on the respective strain gauge than the other.

It is believed that hydraulic load cells, pneumatic load cells, and capacitance pressure detectors (measurement of change in capacitance resulting from the movement of an elastic element) can be used in a similar fashion.

Example 2

Fulcrum/Potentiometer

A simple fulcrum system can be fashioned, to position a potentiometer (variable resistor) in the center of a balanced bar or idler system. This pivoting system becomes unbalanced when the force exerted by one edge of a web substrate against the fulcrum member is greater than the force exerted by the other edge of the web substrate against the fulcrum member. This imbalance causes the fulcrum system to move in the direction of the greater force.

A radial potentiometer, connected to the fulcrum, adjusts the voltage of an applied control signal that activates the system. This method is also believed to be applicable to mechanical lever scales.

Example 3

Photoelectric Sensing

An optical system can be designed to emit light through a polarizing filter. As a web substrate passes over the light source, the web substrate acts as a reflective surface to reflect at least a portion of the polarized light toward a detector. Two or more photoelectric sensors can be used provide comparative feedback.

When the web substrate is taut, maximum reflected signal is received. As the web substrate edge bagginess increases, the amount of reflected polarized light decreases, thereby activating the system.

Example 4

Opacity Sensing

A through beam opacity frequency sensor can be used to sense the relative tension in a web substrate. Using ultra-low frequency (ULF), or back electro magnetic force, senses physical changes in the web substrate, activating the system.

Example 5

Laser

A laser sensor projects a beam of visible or non-visible laser light onto the web substrate. A line scan camera views reflected light from the web substrate. The light travel distance is then computed from the image pixel data. Alternatively, a laser sensor can also be used with a triangulation method to calculate distance, as would be known to one of skill in the art. The presence of a baggy edge alters the distance the reflected light travels indicating that a correction to the folding detour is necessary, thereby activating the system.

Example 6

Ultrasonic

Ultrasonic technology can provide a non-contact sensor to detect distance. Typically, three main variations of ultrasonic sensing modes exist: proximity, retro-reflective, and thru-beam. These sensors provide continuous monitoring of the distance to the edge of a web substrate, causing the system to adjust web substrate tension, as necessary.

Example 7

Nuclear Radiation

Gamma rays are directed through a section of a moving web substrate, for example, the edges. The amount of non-absorbed radiation passing through the web substrate is generally dependent upon the physical characteristics of the web substrate. A radiation sensor converts this non-absorbed radiation into an electrical signal that bears a known relationship to the amount of web substrate material and the resulting force applied thereon, activating the system, as necessary.

Example 8

Inductive Sensing Technique

Inductive weight and/or force sensors utilize the change in inductance of a solenoid coil with changing position of an iron core. In a first embodiment, two coils are present with a common iron core. The system inductance is monitored in both coils as the web substrate physically moves the iron core more toward one coil than the other.

Alternatively, a third coil can be physically located between the two previously described coils, as known to one skilled in the art of inductive sensors. The overall system inductance is monitored and appropriate folding detour corrections made as necessary.

Example 9

Variable Reluctance Sensing Technique

The inductance of one or more coils is changed by altering the reluctance of a small air gap. For example, solenoid coils are mounted on a structure of ferromagnetic material. A "U"-shaped armature is used to complete the magnetic circuit through air gaps. As a web substrate passes between the solenoid coils, a Wheatstone bridge develops a voltage proportional to the translation of the coil assembly. This voltage then activates the system, as needed.

Example 10

Magneto-strictive Sensing Technique

Based on the Villari effect, this sensing technique utilizes the change in permeability of ferromagnetic materials with applied stress. For example, a stack of laminations forms a load-bearing column. Primary and secondary transformer windings are wound on the column through holes oriented in a particular arrangement. The primary windings are excited with an AC voltage and the secondary windings provide the output signal voltage.

When the column is loaded, the induced stresses cause the permeability of the column to be non-uniform, resulting in corresponding distortions in the flux pattern within the magnetic material. Magnetic coupling now exists between the two coils and a voltage is induced into the signal coil as a web substrate passes between, providing an output signal proportional to the applied load, activating the system.

The following numbered examples describe non-limiting exemplary continuously adjustable, self-correcting web folding systems consistent with the scope and spirit of the present invention. However, it should be realized that the present invention is applicable to folders that provide adjustment in discrete increments and/or only a single time.

Example 11

"V"-Folder

A "V"-fold generally comprises a folding system consisting of two folding rails placed at a pre-determined inclination. One of the two folding rails is constructed so that the terminal end is pivotable, thereby allowing expansion of the "V" on one side. The pivotable folding rail is connected to an actuator, preferably a servomotor, so that adjustments can be made by a closed loop feedback from web-edge sensors as discussed supra. The sensors, upon indication of a differential web-edge tension, send a signal to the controller energizing the actuator. The actuator pivots, or increases the included angle of the "V" configuration, thereby increasing tension on the loose edge. Conversely, when an edge sensor indicates excess tightness in the web substrate, the sensor signals a stoppage to the angle adjustment or even a retraction of the included angle to produce web substrate edge equilibrium.

If both web substrate edge sensors are above, or below, a threshold level, another activator can be activated that decreases, or increases, folding detour inclination. An increase in folding detour inclination simultaneously tightens both web substrate edges until a threshold force and/or tension is met.

Example 12

"C"-Folder

A "C"-fold equal path folding system, as would be known to one of skill in the art, generally comprises an inlet elevation angle, $\alpha$, a side angle, $\beta$, and a resultant, exit angle, $\gamma$, as discussed supra. When a web substrate has a baggy edge, a differential edge tension is generally present. When at least one sensor, described supra, senses a differential edge tension, the resultant angle, $\gamma$, is adjusted accordingly. Continuous adjustment can be supplied by a closed loop feedback control between the edge sensor and the pivotable folding detour.

If the low-tension edge is sensed, a signal is sent to a motor controller, energizing a servomotor actuator, thereby changing the angle of the pivotable folding detour. As the edge tension increases, the sensor reduces signal to the controller, reducing the angular increase until equal web-edge tension equilibrium is achieved.

Example 13

"Double-Break"-Folder

A complex "double break"-folder, as would be known to one of skill in the art, incorporates additional pivoting folding rails into a second break section. In other words, a "double break"-folder could be thought of as two individual folders series.

Without wishing to be bound by theory, it is believed that the side angle, $\beta$, of the first folding section, should be made adjustable, rather than the exit or resultant angle, $\gamma$. If the side angle, $\beta$, is adjusted, then the path length of the entire folding system could be increased or decreased to optimize the first fold section. It is likely that the second fold section will also need a pivoting folding rail, in case the overall tension of the second fold section is not translated back to the sensors of the first fold section. Therefore, it would be preferable to provide a secondary, closed-loop system to continuously sense, control, activate, and/or maintain optimum tension within the second fold section of a double break system.

The foregoing examples and descriptions of the preferred embodiments of the invention have been presented for purposes of illustration and description only. They are not intended to be exhaustive or to limit the invention to the precise forms disclosed, and modifications and variations are possible and contemplated in light of the above teachings. While a number of preferred and alternate embodiments, systems, configurations, methods, and potential applications have been described, it should be understood that many variations and alternatives could be utilized without departing from the scope of the invention. Accordingly, it is intended that such modifications fall within the scope of the invention as defined by the claims appended hereto.

What I claim is:

1. An adjustable web folding system for folding a web substrate having a machine direction, a cross-machine direction, and a Z-direction, said adjustable web folding system comprising:

an adjustable folding detour disposed in a position and having a longitudinal axis coincident with said machine direction of said web substrate;

at least one sensor for measuring a physical characteristic of said web substrate prior to said web substrate contacting said adjustable folding detour;

wherein said position of said adjustable folding detour is adjustable to provide equal path lengths for said web substrate in response to the value of said physical characteristic of said web substrate prior to said web substrate contacting said adjustable folding detour.

2. The adjustable web folding system of claim 1 wherein said at least one sensor for measuring said physical characteristic of said web substrate comprises:

a first force measuring sensor for measuring a first force in said web substrate prior to said web substrate contacting said adjustable folding detour; and, a second force measuring sensor for measuring a second force in said web substrate prior to said web substrate contacting said adjustable folding detour.

3. The adjustable web folding system of claim 2 wherein said first force measuring sensor and said second force measuring sensor are spaced in said cross-machine direction of said web substrate.

4. The adjustable web folding system of claim 3 wherein said first force and said second force are compared and produce a resultant force.

5. The adjustable web folding system of claim 4 wherein said position of said adjustable folding detour is adjusted in relation to the magnitude of said resultant force.

6. The adjustable web folding system of claim 4 wherein said resultant force is a comparative measurement of tension in said web substrate.

7. The adjustable web folding system of claim 1 wherein said physical characteristic of said web substrate is selected from the group consisting of tension, opacity, caliper, shear, basis weight, denier, elongation, air flow, stress, strain, modulus of elasticity, coefficient of friction, surface finish RMS, yield strength, color, stiffness, bending modulus, temperature, dielectric constant, static electric charge, physical composition, and combinations thereof.

8. The adjustable web folding system of claim 1 wherein said adjustable folding detour further comprises an edge disposed at an angle relative to said longitudinal axis and defining an included angle therebetween, said edge being moveable to vary said included angle.

9. The adjustable web folding system of claim 1 wherein said adjustable folding detour is selected from the group consisting of folding boards, folding plows, folding rails, goat horns, ram horns, turn bars, folding formers, folding fingers, and combinations thereof.

10. The adjustable web folding system of claim 1 further comprising at least one second sensor wherein said at least one second sensor measures a second physical characteristic of said web substrate after said web substrate contacts said adjustable folding detour said position of said adjustable folding detour being further adjustable in response to the value of said second physical characteristic of said web substrate.

11. The adjustable web folding system of claim 1 wherein said adjustable folding detour is moveable in said cross-machine direction of said web substrate.

12. The adjustable web folding system of claim 2 further comprising at least one third sensor for measuring said physical characteristic of said web substrate, wherein said first, second, and at least one third sensor are capable of providing a profile of said web substrate in said cross machine direction.

13. The adjustable web folding system of claim 1 wherein said adjustable folding detour has a first web contacting edge and a second web contacting edge wherein said fiat web contacting edge and said second web contacting edge intersect.

14. The adjustable web folding system of claim 13 wherein one of said first web contacting edge or said second web contacting edge is moveable.

15. The adjustable web folding system of claim 13 wherein both said first web contacting edge and said second web contacting edge are moveable.

16. The adjustable web folding system of claim 1 wherein said adjustable folding detour is continuously adjustable.

17. An equal path folder comprising:

a folding detour having a longitudinal axis for producing a fold in a web substrate having a longitudinal axis, a machine direction, a cross-machine direction, said web substrate moving in said machine direction;

wherein said folding detour has a folding angle disposed thereon;

a first force measuring sensor for measuring a first force in said web substrate prior to said web contacting said folding board;

a second force measuring sensor for measuring a second force in said web substrate prior to said web contacting said folding board;

wherein said first force and said second force are compared and produce a resultant force; and, wherein said folding angle is adjustable in relation to the value of said resultant force prior to said web contacting said folding board to provide equal path lengths for said web substrate.

18. The equal path folder of claim 17 further comprising:

a guide;

wherein said guide aligns said longitudinal axis of said web substrate with said longitudinal axis of said adjustable folding detour prior to said web substrate contacting said first at least one sensor.

19. A method of folding a web substrate using the adjustable web folding system of claim 1, said method comprising the steps of:

supplying a web substrate having a machine direction and a cross-machine direction, said cross-machine direction being orthogonal to said machine direction and coplanar to said web substrate;

supplying an adjustable folding detour having a longitudinal axis coincident to said machine direction of said web substrate, said adjustable folding detour having at least one adjustable surface disposed thereon;

measuring a physical characteristic of said web substrate prior to said web substrate contacting said adjustable folding detour;

adjusting said adjustable surface in response to the value of said characteristic of said web substrate to provide equal path lengths for said web substrate; and, contacting said web substrate to said adjustable folding detour.

20. The method of folding a web substrate claim 19, said method further comprising the step of:

supplying a guide;

wherein said guide aligns said machine direction of said web substrate with said longitudinal axis of said adjustable folding detour prior to said web substrate contacting said first at lease one sensor.

* * * * *

UNITED STATES PATENT AND TRADEMARK OFFICE

CERTIFICATE OF CORRECTION

PATENT NO. : 7,144,356 B2
APPLICATION NO. : 10/143209
DATED : December 5, 2006
INVENTOR(S) : David Alan Harnish It is certified that error appears in the above-identified patent and that said Letters Patent is hereby corrected as shown below:

Column 12

Line 1, delete “fiat” and insert --first--.

Column 12

Line 62, delete “lease” and insert --least--.

Signed and Sealed this

Twenty-sixth Day of June, 2007

JON W. DUDAS
*Director of the United States Patent and Trademark Office*